US008573556B1

(12) United States Patent
Baker et al.

(10) Patent No.: US 8,573,556 B1
(45) Date of Patent: Nov. 5, 2013

(54) VERTICAL CONCRETE COLUMN FORM AND METHOD OF FORMING SAME

(75) Inventors: William Brent Baker, Heber, UT (US); David McKay Balls, Oakley, UT (US); Daniel M. Balls, Oakley, UT (US); Mike Sharp, Sandy, UT (US)

(73) Assignee: Verti-Crete, LLC, Sandy, UT (US)

( * ) Notice: Subject to any disclaimer, the term of this patent is extended or adjusted under 35 U.S.C. 154(b) by 1939 days.

(21) Appl. No.: 11/254,217

(22) Filed: Oct. 18, 2005

(51) Int. Cl.
*E04G 13/02* (2006.01)

(52) U.S. Cl.
USPC ..... 249/48; 249/112; 249/139; 249/155; 249/159; 249/168

(58) Field of Classification Search
USPC ..... 264/337; 249/139, 155
See application file for complete search history.

(56) References Cited

U.S. PATENT DOCUMENTS

| | | | | |
|---|---|---|---|---|
| 1,726,817 | A | 9/1929 | Franklin | |
| 1,760,282 | A | 5/1930 | Pedersen | |
| 3,010,174 | A | 11/1961 | McCall | |
| 3,913,518 | A | 10/1975 | Kaplan | |
| 4,061,435 | A | 12/1977 | Schmanski et al. | |
| 4,078,867 | A | 3/1978 | Ronden | |
| 4,125,973 | A * | 11/1978 | Lendrihas | 249/188 |
| 4,175,883 | A | 11/1979 | Lemelson | |
| 4,181,286 | A * | 1/1980 | Van Doren | 249/82 |
| 4,196,550 | A | 4/1980 | Svensson | |
| 4,424,951 | A * | 1/1984 | Spencer | 249/48 |
| 4,432,172 | A | 2/1984 | Kuykendall et al. | |
| 4,435,107 | A | 3/1984 | Sweeney | |
| 4,522,530 | A | 6/1985 | Arthur | |
| 4,563,668 | A | 1/1986 | Martino | |
| 4,564,309 | A | 1/1986 | Bjorlund | |
| 4,772,869 | A | 9/1988 | Grammas | |
| 4,842,241 | A * | 6/1989 | Fitzgerald et al. | 249/50 |
| 4,978,099 | A * | 12/1990 | Carlson | 249/48 |
| 5,090,348 | A | 2/1992 | Hugron | |
| 5,199,814 | A | 4/1993 | Clark et al. | |
| 5,205,236 | A | 4/1993 | Hughes | |
| 5,267,523 | A | 12/1993 | Hugron | |
| 5,566,638 | A | 10/1996 | Rokosny | |
| 6,014,941 | A | 1/2000 | Bent et al. | |
| 6,099,203 | A | 8/2000 | Landes | |
| 6,113,307 | A | 9/2000 | Joyner et al. | |
| 6,375,385 | B1 | 4/2002 | Kennedy | |
| 6,745,529 | B2 | 6/2004 | Beltran | |
| 6,769,380 | B1 | 8/2004 | Carvajalino | |
| 6,808,667 | B2 * | 10/2004 | Nasvik et al. | 264/219 |
| 2003/0085481 | A1 * | 5/2003 | Nasvik et al. | 264/31 |

FOREIGN PATENT DOCUMENTS

| | | |
|---|---|---|
| GB | 1 369 862 | 10/1974 |
| WO | WO 94/22648 | 10/1994 |

* cited by examiner

*Primary Examiner* — Amjad Abraham
(74) *Attorney, Agent, or Firm* — Thorpe North & Western LLP

(57) ABSTRACT

A form for creating a pattern in uncured concrete during a vertical column casting process includes an end wall and at least one side wall, extending from an edge of the end wall with the side wall and end wall cooperatively defining a corner therebetween. A pliable liner is attached to the end wall and the side wall and operably joins the side wall to the edge of the end wall to define a mold cavity. At least one patterned surface is formed on or in the pliable liner and is operable to form a corresponding pattern into concrete disposed in an uncured form in the old cavity. A notch is formed in the pliable liner and extends along the corner and forms a pivotable joint between the end wall and the side wall to facilitate removal of the form device from about the concrete after the concrete has at least partially cured.

10 Claims, 7 Drawing Sheets

VERTICAL CONCRETE COLUMN FORM AND METHOD OF FORMING SAME

BACKGROUND OF THE INVENTION

1. Field of the Invention

The present invention relates generally to a system for vertically forming concrete columns for use in erecting concrete fences, walls and related structure.

2. Related Art

Vertically oriented concrete walls have been used for many years in applications including highway, residential and commercial enclosures. Concrete panels and columns are often poured and cured in a central manufacturing area and shipped fully formed and cured to a job site, where the panels and columns can be assembled into a fence or similar structure. It is often desirable to apply a textured, decorative finish to the concrete panels and columns to enhance the appearance of the fence. Decorative finishes such as pseudo-brick finishes, pseudo-rock wall finishes, etc., give the concrete panels and columns a more aesthetically pleasing appearance, and in some cases, such as in sound wall applications, can increase the effectiveness of the concrete wall or fence.

Due to the difficulties inherent in horizontally forming concrete columns from uncured concrete, conventional column casting processes generally utilize a vertical mold system into which uncured concrete is poured to form concrete columns which will later be used to erect a concrete wall or fence. Such vertical mold systems generally include a plurality of panels that are assembled into a substantially rectangular form to receive the uncured concrete. Panels used in such a manner often include a decorative pattern applied thereto, which forms a corresponding or inverse decorative pattern in the concrete column poured within the panels. Due to the significant weight of the uncured concrete disposed within the column mold system, and the fact that uncured concrete tends to flow through any cracks or holes in a form system, assembling a vertical column mold system that is capable of forming structurally sound, aesthetically pleasing columns has proved difficult.

For example, attempts have been made to secure individual form panels (or sheets of material) into a rectangular form structure by securing, by either internal or external means, the panels at 90° to one another to form 90° corners of the mold. However, such attempts have often resulted in uncured concrete seeping or flowing at least partially between the areas where the panels meet. The concrete that seeps or flows through the cracks must, after curing, be ground, chipped or otherwise removed from the cured concrete column. To address this problem, attempts have been made to create a form with two or more panels rigidly coupled together into a 90° angle to prevent uncured concrete from seeping or flowing out of the corner structure of the mold.

While such attempts have at least partially addressed the problem of seepage of uncured concrete from forms during the casting process, this solution has resulted in further problems. For example, after the concrete has cured, the "corner" mold structure must be pulled from the column without damaging either the cured concrete or the corner mold structure. That is, once the concrete has cured, the panels coupled into a 90° angle must be forcibly spread apart or expanded to an angle greater than 90° before the panels can be removed. This problem is exacerbated when attempts have been made to couple two "corner" panels into one U-shape mold form. In this scenario, each of the two arms of the U-shaped mold must be peeled away from the cured concrete, which results in great stress being applied to the components of the U-shaped mold.

These problems are made worse when a decorative pattern is formed on the concrete column that was formed, as the concrete generally cures within the indentations of the decorative pattern, and the corner panel structure must be "spread" to an even greater degree to remove the corner panel structure from the cured column. While it may be possible to spread corner panel structures one or two times to reuse the corner panels, repeated cycling of the corner panel structure can result in the panel structure becoming unusable after time. As the cost to prepare typically polymer-lined forms for this purpose can be relatively expensive, frequently replacing form panels due to premature failure can significantly increase the costs associated with forming the concrete columns.

SUMMARY OF THE INVENTION

It has been recognized that it would be advantageous to develop a system for vertically forming concrete columns that can effectively retain uncured concrete within vertical forms. It has also been recognized that it would be advantageous to develop a form system for vertically forming concrete columns having forms that can be easily and repeatedly removed from the columns after the concrete has cured.

The invention provides a form for creating a pattern in uncured concrete during a vertical column casting process, including an end wall, and at least one side wall, extending from an edge of the end wall, the side wall and end wall cooperatively defining a corner therebetween. A pliable liner can be attached to the end wall and the side wall, and can operably join the side wall to the edge of the end wall to define a mold cavity. At least one patterned surface can be formed on or in the pliable liner, and can be operable to form a corresponding pattern into concrete disposed in an uncured form in the mold cavity. A notch can be formed in the pliable liner, and can extend along the corner and can form a pivotable joint between the end wall and the side wall to facilitate removal of the form device from about the concrete after the concrete has at least partially cured.

In accordance with another aspect of the invention, a system for vertically molding concrete columns during a column casting process is provided, including a pair of elongate, U-shaped forms, positionable to define an elongate tetragonal mold cavity. Each U-shaped form can have a pair of elongate corners formed between an elongate end wall and a pair of elongate side walls. A pliable liner can be attached to each of the U-shaped forms, and can have at least one patterned surface exposed toward the mold cavity and can be operable to form a pattern in concrete in an uncured state. A pair of notches can be formed in each pliable liner externally of the mold cavity and can extend along the pair of elongate corners and can define a pivotable joint between each of the side walls and the end wall. Securing structure can be associated with the U-shaped forms and can be configured to retain the forms in a secure configuration to receive the concrete in an uncured state within the mold cavity.

In accordance with another aspect of the invention, a method of making a vertical column concrete form is provided, including the step of: positioning at least one side wall along an edge of an end wall to form at least one corner between the end wall and the at least one side wall; disposing a pliable liner about the end wall and the at least one side wall to operably join the at least one side wall to the end wall and to form a mold cavity therebetween; creating at least one patterned surface on the pliable liner for forming a corresponding pattern in uncured concrete disposed within the mold cavity; and forming at least one notch in the pliable liner, the at least one notch extending along the at least one corner, to create at least one pivotable joint between the end wall and the at least one side wall.

Additional features and advantages of the invention will be apparent from the detailed description which follows, taken in conjunction with the accompanying drawings, which together illustrate, by way of example, features of the invention.

DETAILED DESCRIPTION

Figure 1:
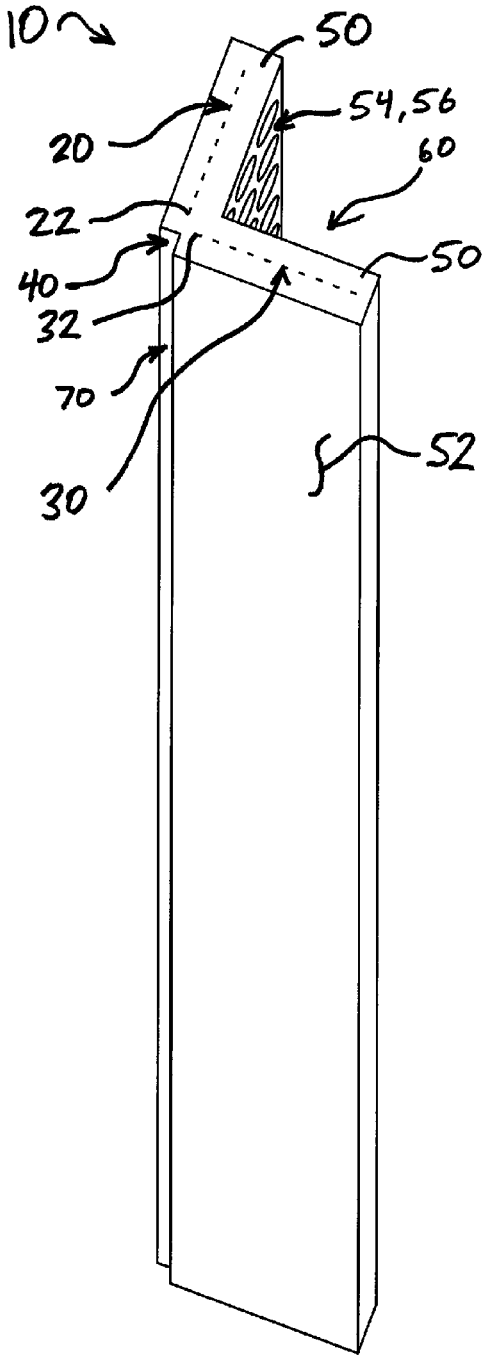
FIG. 1 is a top, front perspective view of a vertical concrete column form in accordance with an embodiment of the present invention, shown in a closed configuration.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention provides a concrete casting form that can be used to cast a concrete column in a vertical orientation. Vertical concrete columns formed in accordance with the present invention can be used in a variety of applications, including residential and commercial fencing, sound wall applications, etc. Such concrete columns generally require little or no maintenance, provide superior strength, and can be relatively quickly assembled on the job site into a fence or other structure. Assembly of the columns into a fence structure is generally accomplished by installing concrete wall panels (not shown) between two or more columns, with the wall panels sliding into notches or slots in the columns to be thereby securely retained by the columns.

Figure 2:
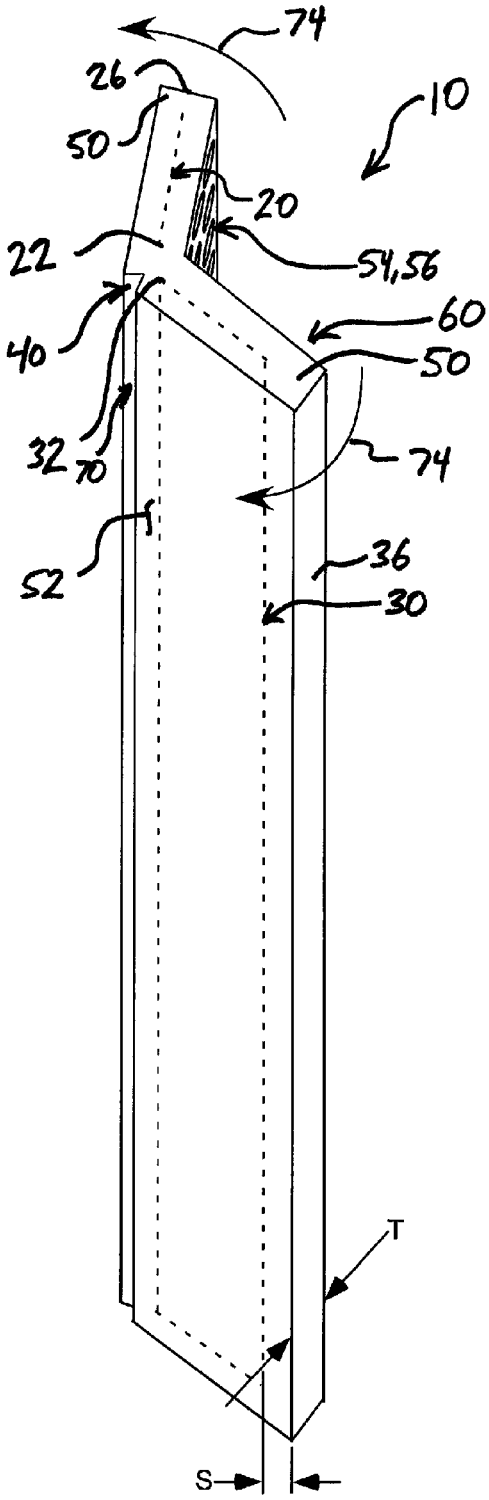
FIG. 2 is a top, front perspective view of the vertical concrete column of FIG. 1, shown in an open configuration.

Illustrated in FIGS. 1 and 2 is an example of a vertical concrete column form 10 for creating a pattern in uncured concrete during a vertical column casting process. The form 10 can include an end wall (shown schematically by dashed line 20) and a side wall (shown schematically by dashed outline 30). The end wall and side wall can function to reinforce the form 10 and can be made from a variety of materials such as sheet wood, plywood, sheet metal, expanded metal, and the like. Due to the advantageous corner structure of the present invention (discussed in more detail below), the end wall and side wall can be formed of a rigid material that need not flex when the form is removed from a cured concrete column, and as such is not subjected to significant flexural stressing during the "tear down" process after the column has cured.

The end wall 20 and side wall 30 can, in the embodiment shown in FIGS. 1 and 2, cooperatively create an L-shaped form 10. Specifically, an edge 32 of the side wall can abut a corresponding edge 22 of the end wall. The side wall 30 can thus extend away from the edge 22 of the end wall 20 and a corner 40 can thereby be formed at the intersection of the side wall edge 32 and the end wall edge 22.

A pliable or polymeric liner 50 can be disposed about or coupled to each of the end wall 20 and the side wall 30. In one aspect of the invention, the pliable liner 50 operably joins the side wall 30 to the end wall 20 at corner 40. In the embodiment shown in FIGS. 1 and 2, the polymeric liner 50 can have an exterior surface 52 and an interior surface 54 which can include a decorative pattern 56 formed thereon or therein. The interior surface 54 can define the outer edges of a mold cavity 60 into which uncured concrete can be poured during a concrete casting process.

Attachment of the pliable liner 50 to the end wall 20 and side wall 30 can be accomplished in a number of manners. In one aspect of the invention, the end and side wall are formed from sheet material, such as AC plywood, and the pliable liner is bonded to the sheet material by methods known to those of ordinary skill in the art. In those aspects of the invention where expanded metal is used in or for the end and side walls, the holes or perforations in the expanded metal can aid in retaining the pliable liner in position on or in the end or side wall, thereby providing excellent adhesion of the polymeric liner to the expanded metal. The polymeric or pliable liner can be formed from a variety of materials, and in one embodiment is formed of a TDI system-based polyurethane sold by the Synair corporation under the tradename SX 50.

The size of the end wall 20 and side wall 30 can vary according to column size for a particular application. In one aspect of the invention, illustrated by example in FIG. 2, a thickness "T" of the end or side wall can be on the order of three inches (with a plywood sheet consuming approximately ¾ inches of this total). Also, there can exist a space "S" of approximately 3 inches between an edge or end of the side wall or end wall and a location where the pliable liner terminates (e.g., the space "S" shown in FIG. 2 does not include plywood but only a full-thickness portion of pliable liner).

The polymeric liner 50 can have at least one patterned surface 56 formed thereon or therein. In one embodiment of the invention, the pattern can be decorative and is advantageously simultaneously formed in the concrete column during the casting by both the end wall 20 and the side wall 30. The patterned surface 56 can be of a variety of designs, and can include an inverse decorative pattern such as pseudo-rock wall, a pseudo-brick wall, etc., or other such desirable patterns. The pattern can also be a decorative logo or an alphanumeric sign. As used herein, the term "decorative pattern" is understood to mean a pattern applied to the concrete panels, and may be decorative or functional, or both, in nature. In addition to including the decorative pattern formed on the cast concrete column, the finished concrete column can be stained or dyed in a particular color scheme to enhance the aesthetically pleasing appearance of the column.

The decorative patterned surface 56 can be formed on the end wall 20 or side wall 30 in a number of manners. In one aspect, a decorative patterned surface 56 can be formed in or on the polymeric liner 50 by preparing a "master" form (not shown) over which an uncured viscous polymer can be poured. When the viscous polymer cures, the resulting polymer liner can be removed from the master form and bonded or otherwise attached to an end wall 20 and a side wall 30 to create the form 10. Once prepared, the form 10 can be used numerous times to apply the decorative pattern to a number of concrete panels poured in cavities defined by the end wall and side wall forms. Also, each form 10 can include a decorative patterned surface 56 that differs from adjacent forms, or can include no pattern, in the case that a "plain" concrete column is to be formed.

The pliable or polymeric liner 50 can also include a notch 70 formed therein. The notch 70 can extend along a longitudinal length of the corner 40. The notch can aid in forming a pivotable joint between the end wall 20 and the side wall 30 to facilitate removal of the form 10 from about the concrete after the concrete has at least partially cured. Thus, the end wall 20 and side wall 30 can be pivoted with respect to one another between an open position, as shown in FIG. 2, and a closed position, as shown in FIG. 1. While the notch is shown in the figures as being generally square or rectangular in cross section, it is to be understood that the notch can include a variety of cross sectional shapes, including a half-circular indentation, oval-shaped indentation, etc.

As used herein, the term "open position" is to be understood to refer to a position in which the column forms can be removed from a cured concrete column, and generally includes a configuration in which the end and side walls define an angle greater than 90°. As used herein, the term "closed" is to be understood to refer to a position in which the column form is configured to be positioned to receive uncured concrete therein. In the closed position, the end and side walls will generally form an angle of about 90°. The notch 70 can be biased so that the pivotable joint normally retains the side wall 30 in the closed position with respect to the end wall 20. In this manner, the form is normally closed but can be relatively easily "opened" into the open position to remove the form from the cast column after the column has cured.

In operation, uncured concrete is generally cast into the form 10 and allowed to cure with the end wall 20 and side wall 30 retained in the closed position. After the concrete has sufficiently cured, the distal end 26 of the end wall 20 and the distal end 36 of the side wall 30 can be moved relative to one another into the open position, as indicated by the arrows 74 in FIG. 2. In this manner, a majority of the inner surfaces of the side wall and end wall can be moved out of contact with the cured concrete column to allow the form to be relatively easily removed from the cured column.

Figure 3:
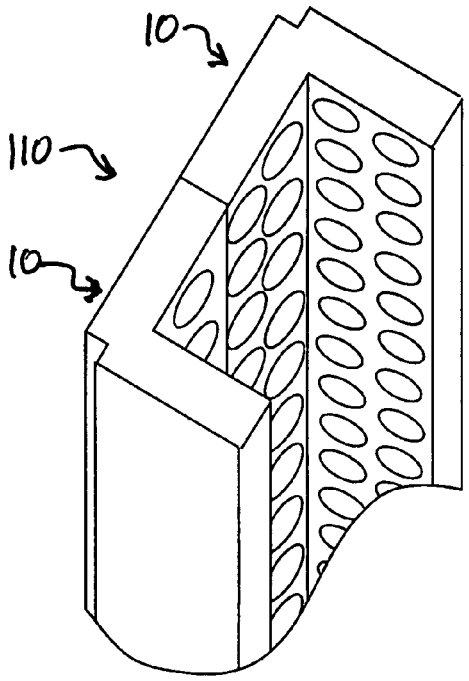
FIG. 3 is a top, front perspective view of a two vertical concrete column forms in accordance with an embodiment of the present invention, shown complementing one another to form a two-corner panel form.
Figure 4:
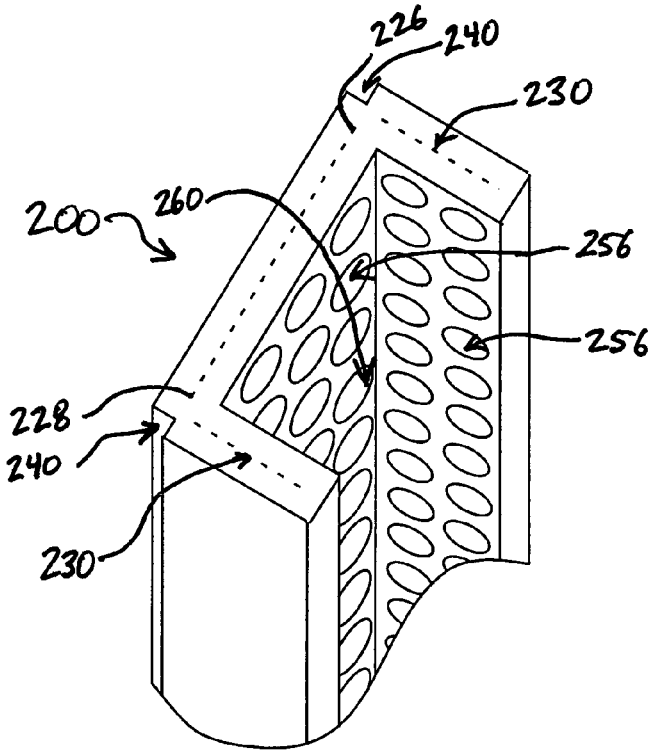
FIG. 4 is a top, front perspective view of another vertical concrete column form in accordance with an embodiment of the invention.

In the aspect of the invention illustrated in FIG. 3, a pair of vertical concrete column forms 10 for creating a pattern in uncured concrete during a vertical column casting process are shown complementing one another to form a U-shaped mold 110. Illustrated in FIG. 4 is an example of a vertical concrete column form 200 for creating a pattern in uncured concrete during a vertical column casting process, formed in accordance with another aspect of the invention. In this embodiment, a pair of opposing side walls 230 can be coupled to and can extend away from opposing edges 226 and 228 of end wall 220 to form a pair of corners 240 with the end wall 220.

FIG. 4 also shows the end wall 220 and side walls 230 can each include inverse decorative patterns 256 disposed thereon. As uncured, or "wet" concrete is poured into the mold cavity 260, the weight of the wet concrete will generally ensure that the concrete fills in and around the textured surface of the inverse decorative pattern 256. After cure, the textured surface appears in the cured concrete column as a decorative pattern (394 in FIG. 6*b*), such as a brick wall appearance, a rock wall appearance, etc. Because the present invention advantageously forms concrete columns in a vertical orientation, the wet concrete can uniformly fill the textured surface of inverse decorative patterns on all sides of the mold cavity.

Figure 5:
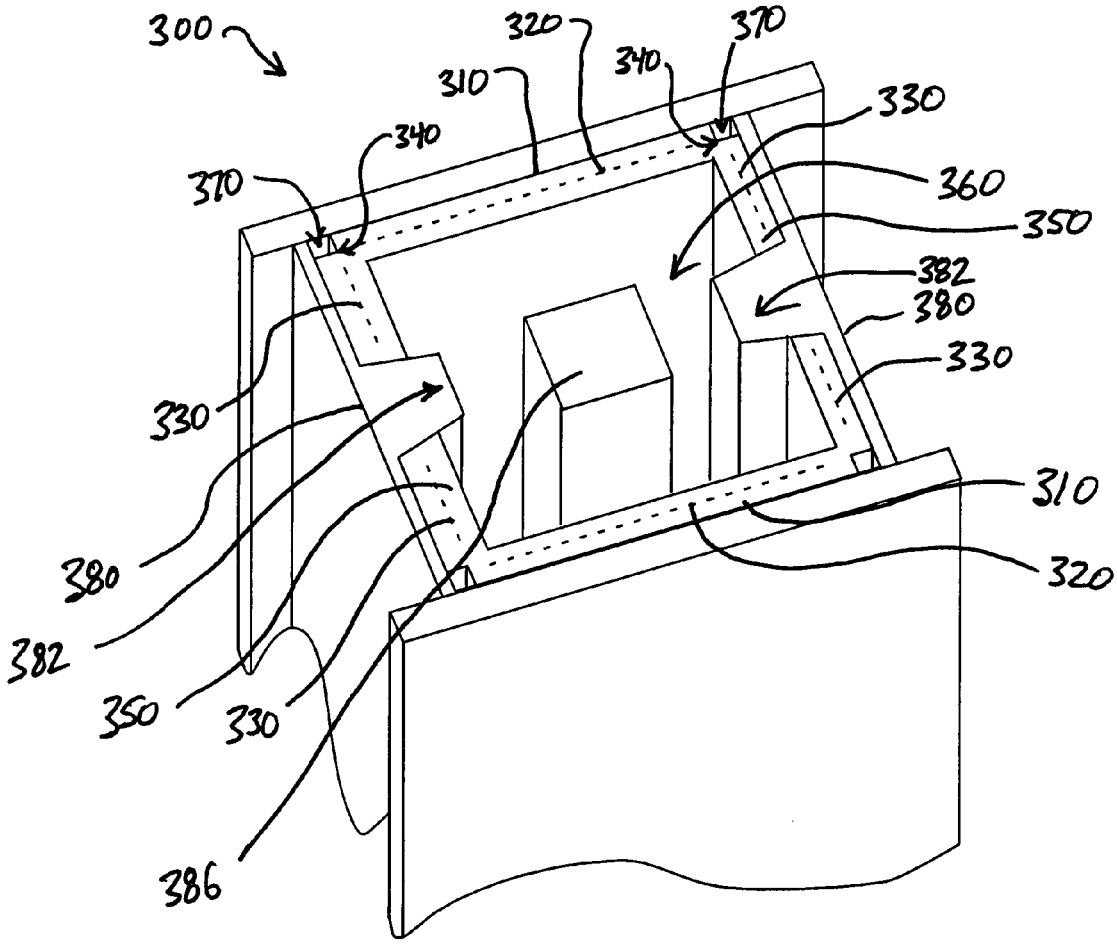
FIG. 5 is a top, front perspective view of a vertical concrete column form system in accordance an embodiment of the present invention.

Illustrated in FIG. 5 is an example of a system 300 for vertically molding a concrete column during a vertical column casting process, formed in accordance with another aspect of the invention. The system 300 can have a pair of elongate, U-shaped forms 310 that can be positioned to define an elongate tetragonal mold cavity 360. Each U-shaped form can have a pair of elongate corners 340 formed between an elongate end wall 320 and a pair of elongate side walls 330. As in previously discussed embodiments, a pliable or polymeric liner 350 can be disposed about or coupled to each of the U-shaped forms 310.

A pair of notches 370 can be formed in each polymeric liner 350. The notches 370 can be external to the mold cavity 360, and can extend along the pair of elongate corners 340. The notches 370 can create a pivotable joint between the side walls 330 and the end wall 320. Thus, the end wall 320 and side walls 330 can be pivoted with respect to one another between an open position (as in FIG. 6*b*) and a closed position (as in FIG. 6*a*). The notch 370 can be biased so that the pivotable joint normally retains the side walls 330 in the closed position with respect to the end wall 320.

Figure 6A:
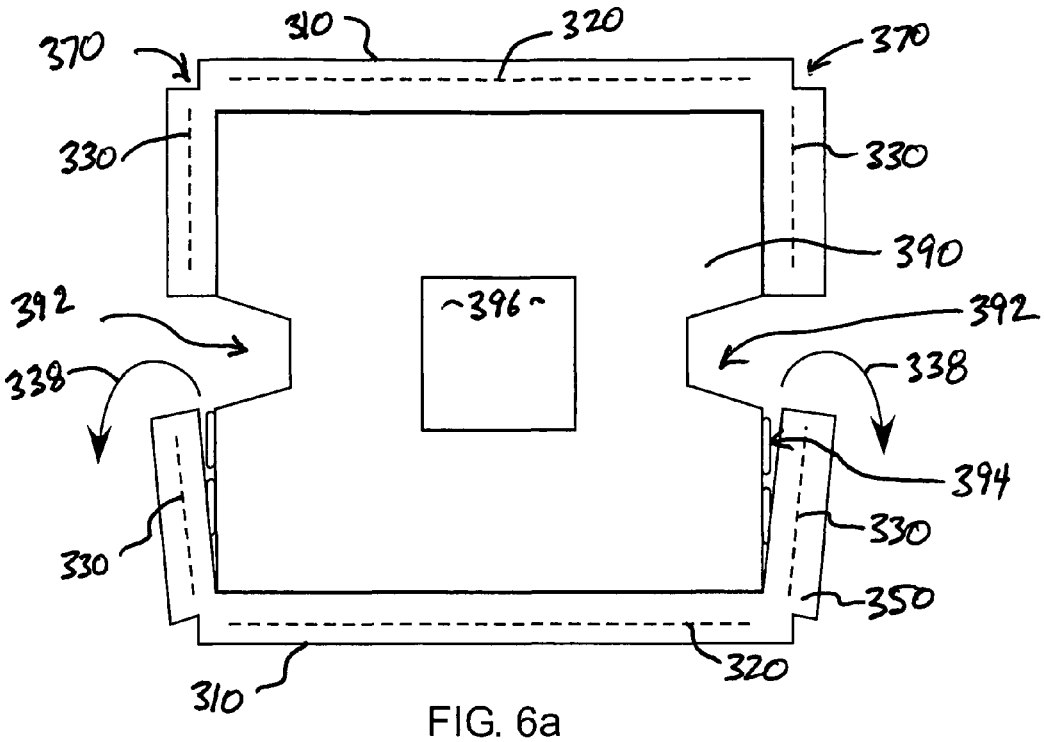
FIG. 6*a* is a top view of the vertical column form system of FIG. 5, shown in a closed configuration with a cast vertical concrete column disposed in the tetragonal mold cavity.
Figure 6B:
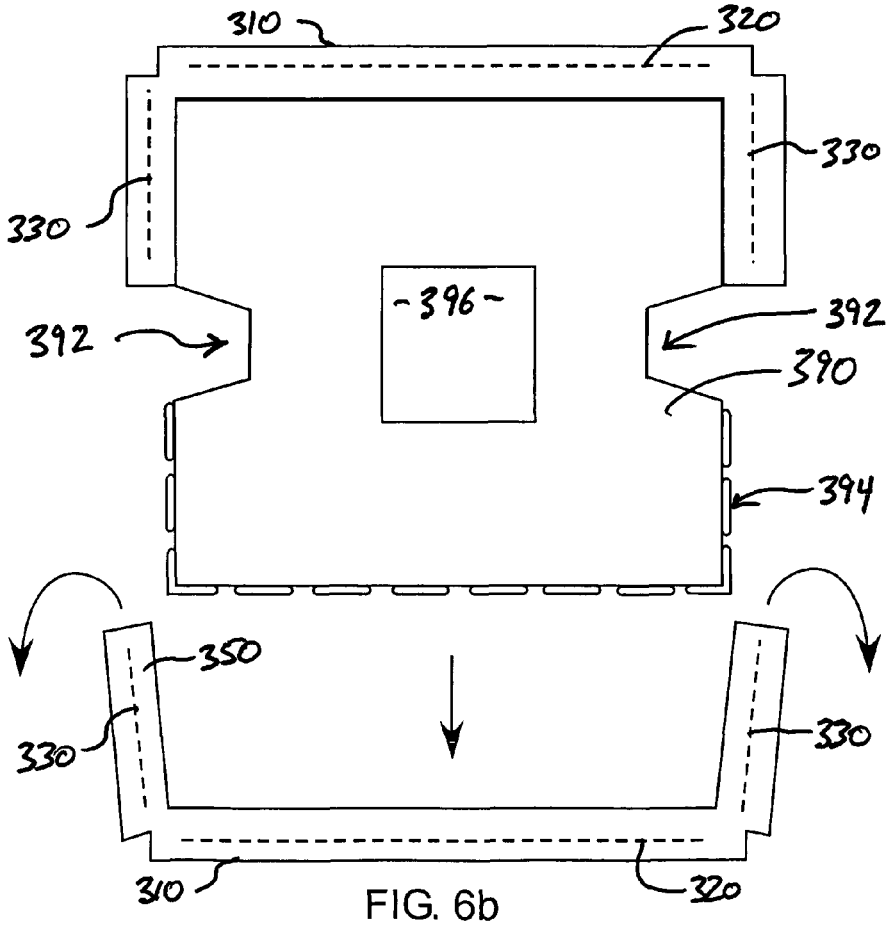
FIG. 6*b* is a top view of the vertical column form system of FIG. 5, shown in an open configuration with a cast vertical concrete column disposed in the tetragonal mold cavity.

FIGS. 6*a* and 6*b* illustrate the operation between the open and closed positions of the pivotable joint created by the notch 370 with respect to a vertically formed concrete column 390 having a patterned surface 394. Specifically, FIG. 6*a* shows a top view of a concrete column 390 within a tetragonal mold cavity created by two U-shaped forms 310. The side walls 330 can be pivoted away, as shown by arrows 338, from the concrete column 390 to release the sufficiently cured concrete column from the patterned surface (not shown in FIGS. 6*a* and 6*b*) of the polymeric liner 350. Once the side walls are free from the concrete, the form 310 can be pulled away from the cured concrete column as shown in the lower portion of FIG. 6*b*.

It will be appreciated that with the patterned relief 394 formed in the concrete by the patterned surface, removal of the forms from the cured concrete typically requires that the side walls be pivoted away from the cured concrete column 390. The present invention addresses this problem by enabling rotation of the side walls relative to the end wall via hinge or notch 370. In this manner, the forms can be reused multiple times without premature damage to the forms or the decorative surface applied on or in the pliable liner 350.

Returning to FIG. 5, the system 300 can also include have a pair of side retainers 380 that can be configured to form notches (392 in FIG. 6*b*) in the mold cavity 360 between the pair of elongated U-shaped forms 310. The side retainers 380 can be formed of any suitably rigid and strong material such as metal or wood. The side retainers 380 can be placed adjacent to the side walls 330 of the U-shaped forms 310, and retain the side walls 330 in the closed position when uncured concrete is cast into the tetragonal mold cavity 360.

The side retainers 380 can have a notch mold 382 formed therein or coupled thereto. The notch mold 382 can be located between, and can separate, the side walls 330 of adjoining U-shaped forms 310. The notch mold 382 can extend into the tetragonal mold cavity 360 so that when a column is cast, uncured concrete will form around the notch mold 382. In this way, a notch 392 can be created in the vertical column 390 when the concrete is sufficiently cured, as shown in FIGS. 6*a* and 6*b*. It will be appreciated that a vertical column 390 having notches 392 can be used in construction of vertical walls or fences where a wall member can be configured to fit within the notch 392 between adjacent columns 390. The notch mold 382 in the side retainers 380, in combination with the U-shaped forms 310, advantageously limits or prevents uncured concrete from flowing outward from the mold cavity 360.

The system 300 can also include a removable center post 386. The center post 386 can be positioned near the center of the mold cavity 360, and can be made from any suitably rigid and strong material such as metal or wood, including tubular steel. The center post 386 can extend the full length of the column 390, or only through a portion of the column. Thus, when uncured concrete is cast into the tetragonal mold cavity 360, the uncured concrete will flow around the center post 386. After the concrete is sufficiently cured, the center post 386 can be removed, leaving an aperture, or center post hole, 396 through the approximate center of the vertical column 390, as shown in FIGS. 6*a* and 6*b*.

It will be appreciated that a central portion of concrete, and the weight thereof, can be eliminated from the vertical column 390 without significantly affecting the structural integrity of the vertical column. Thus, a significantly lighter vertical column 390 can be created by use of the center post 386 during casting of the column.

Additionally, it will be appreciated that a vertical concrete column 390 will generally need to be secured to prevent tipping or falling of the column. The aperture or center post hole 396 created by the center post 386 enables attachment of the vertical column 390 to suitable foundational structure, such as a footing. Specifically, the foundation or footing can be created with vertically extending support rods, such as rebar, that can fit within the aperture or hole 396 created by the center post in a vertical concrete column 390. The vertical concrete column can then be placed over the footing such that the vertical support rods extend into the aperture or center post hole 396. The aperture or center post hole can then be filled with a hardening slurry material, such as grout or cement. Thus, the center post 386 can create a grout cell in the cast vertical concrete column 390 and can secure the vertical concrete column 390 to the footing.

Figure 7:
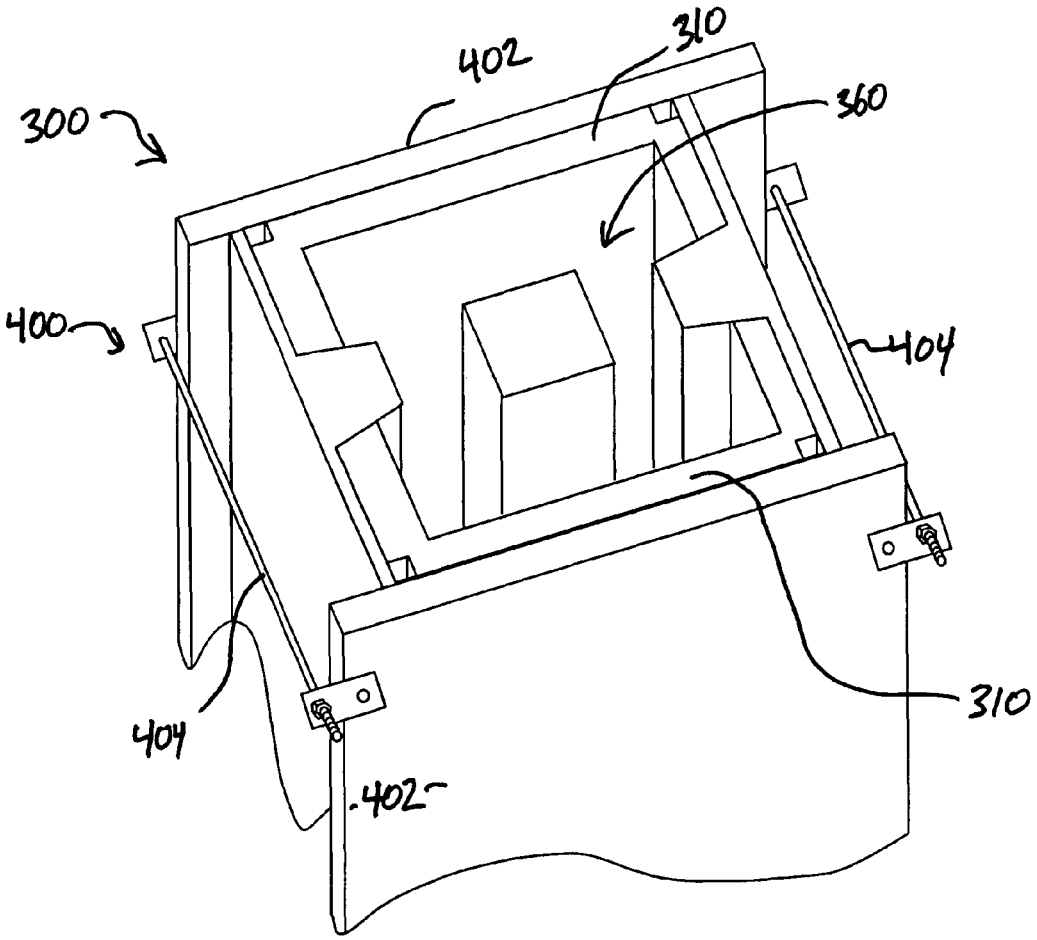
FIG. 7 is a top, front perspective view of the vertical column form system of FIG. 5 with securing structure attached thereto.

Referring to FIG. 7, the form system 300 can also include securing structure 400, such as retaining walls 402 and tension members 404, associated with the U-shaped forms 310. Due to the substantial weight of uncured concrete, the various forms will tend to move outwardly from the defined mold cavity upon introduction of wet concrete into the cavity. The securing structure 400 can be configured to retain and secure the position and location of the U-shaped forms 310. At least one tensioning member 404 can be operatively coupled to each retaining wall 402 to apply a retaining force to the U-shaped forms 310 to retain the U-shaped forms in a tetragonal configuration while concrete in the uncured state is received in the mold cavity 360.

Securing structure 400 can include a variety of structures sufficient to manipulate and support the various forms and retaining walls. For example, handles (not shown) or similar structure can be included on the side wall forms to facilitate easy movement of the forms by operators. The tensioning members 404 can be located outside the U-shaped forms 310 so that the tensioning members do not displace the uncured concrete as it is being cast into the mold cavity 360. Thus, when uncured concrete is cast into the mold cavity 360 the U-shaped forms 310 will not move, but instead will remain in place, thereby retaining the uncured concrete into the desired vertical column configuration. In this manner, the U-shaped forms 310 are securely held in position without adversely affecting the finished panel by introducing foreign matter into the wet concrete and without leaving cavities in the concrete, as has been done in previous methods. In this manner, the concrete forms are maintained securely in place prior to curing of the concrete without compromising either the structural integrity or aesthetic appearance of the finished concrete columns.

The tensioning members 404 can be a variety of those known in the art, and can include threaded ends which can be secured in place by fasteners. An opposing threaded end can similarly be secured. Each of the fasteners can be tightened to tension the retaining walls 402 together. To provide for variation in the number of mold cavities 360 formed, the tensioning members 404 can include a length of threads that allow fasteners to be attached in a variety of positions to facilitate tensioning of a varying number of concrete forms 310.

Figure 8A:
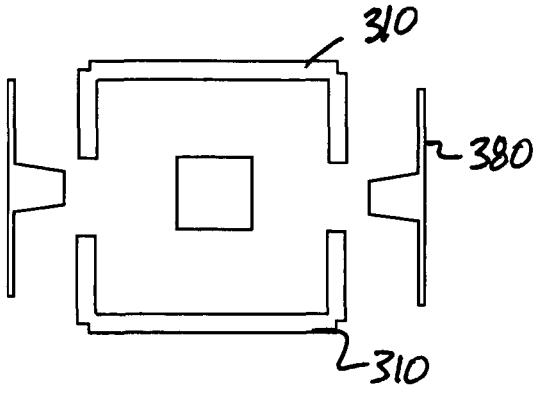
FIG. 8*a* is a top view of the vertical column form system of FIG. 5 having two U-shaped forms.
Figure 8B:
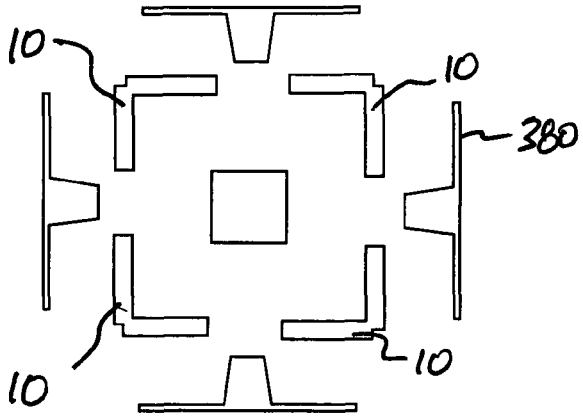
FIG. 8*b* is a top view of the vertical column form system of FIG. 5 having four L-shaped forms.
Figure 8C:
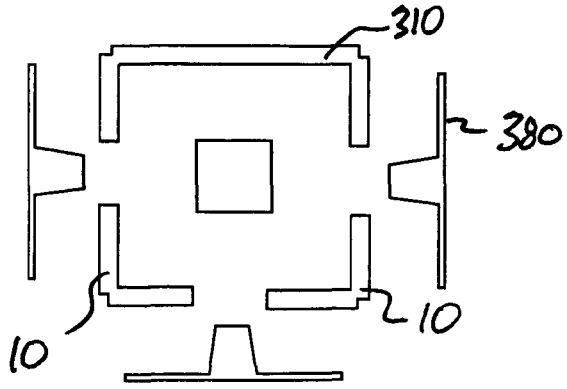
FIG. 8*c* is a top view of the vertical column form system of FIG. 5 having one U-shaped form and two L-shaped forms.

It will also be appreciated that notch molds 382 can be used with any combination of U-shaped forms 310 and L-shaped forms 10, previously described in FIGS. 1-2, to locate notches in any of the sides of a vertical concrete column. Thus, as shown in FIGS. 8*a*-8*c*, columns can be formed with notches in opposite sides, as shown in FIG. 8*a*, all four sides, as shown in FIG. 8*b*, or in three adjacent sides, as shown in FIG. 8*c*. Other notch configurations can also be conceived.

Figure 9:
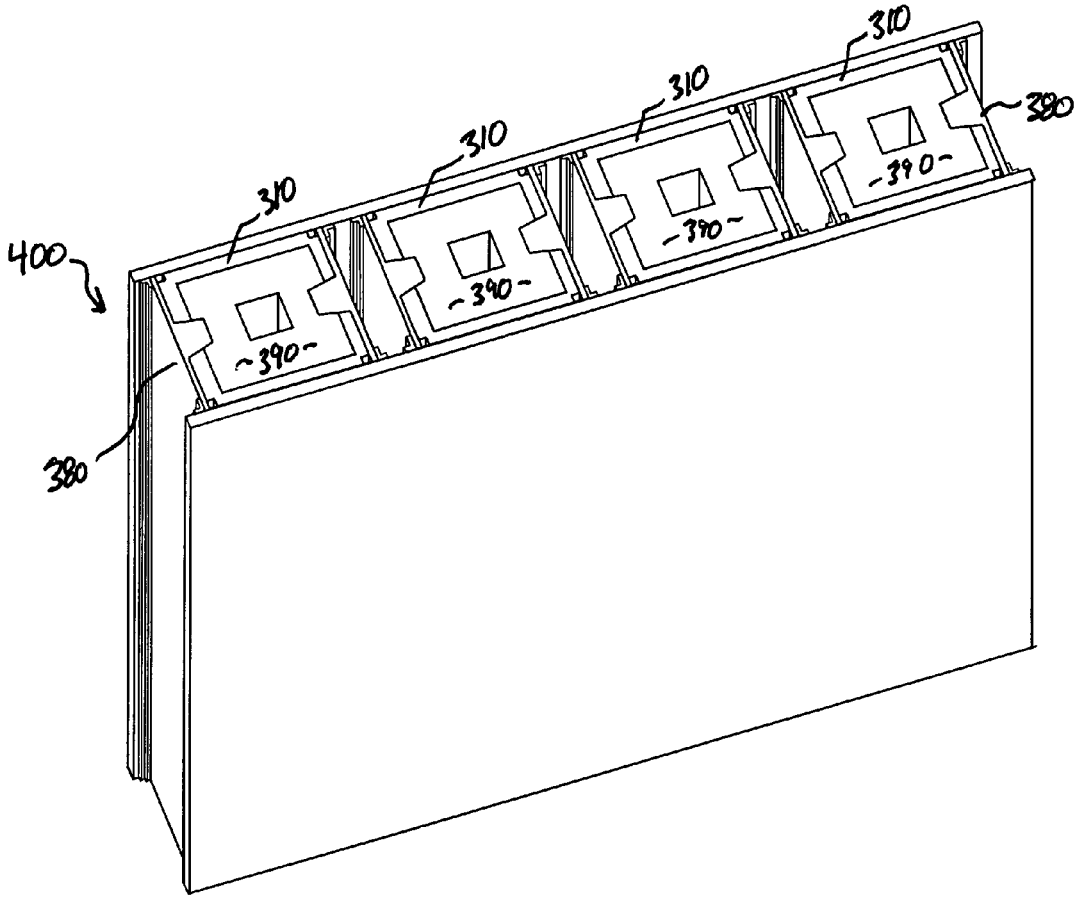
FIG. 9 is a perspective view of a plurality of vertical column form systems of FIG. 5.

Referring now to FIG. 9, illustrated is a plurality of U-shaped forms 310 defining a plurality of tetragonal mold cavities placed within the securing structure 400. In this embodiment, the U-shaped forms 310 can be positioned to define a plurality of vertical mold cavities that each corresponds to a concrete column 390 to be formed. As discussed above, various tensioning and restraining devices can be used to ensure that the mold forms are not displaced by the introduction of uncured concrete in the mold cavity. Once each mold cavity is defined, and any retaining structure has been applied, wet concrete can be poured into each mold cavity. Vibrators or other agitating devices can be utilized when pouring the wet concrete to minimize voids and ensure the wet concrete fills each cavity to the extent desired.

After pouring, the concrete in the forms can be allowed to cure, after which the various retaining structure and forms can be removed. The cured columns can then be removed from the support frame assembly. In one aspect, the columns are removed by lifting equipment (not shown) which can lift each panel vertically away from the support frame assembly. The process can then be repeated a number of times to create a number of concrete columns. In the case where the proper concrete mix is used, the system can form columns on a one day cycle, that is, columns can be poured in the morning and allowed to cure through the night. The following morning, the cured columns can be removed, the forms can be reassembled, and the process begun again.

While four mold cavities (corresponding to four columns 390) are shown in the system of FIG. 9, the present invention can advantageously be used to vertically form any number of columns by providing fewer or more U-shaped forms 310 and accompanying support structure 400. In this manner, the system can be tailored to specific casting or pour requirements. For example, a specific number of columns with a particular decorative pattern can be simultaneously poured, perhaps to correspond to a specific length of fence desired.

The present system can be formed as an integral unit that can be moved from one location to another. In this manner, a series of mold forms can be created and secured, the forms can be filled with wet concrete, and the entire system can be lifted onto a truck and moved to a job site. The columns can cure in the area in which they were poured, or can cure while in transit to a job site, saving down-time otherwise necessary to ensure the columns are cured prior to shipping. Once cured, the concrete columns can be easily removed from the forms and assembled into a fence structure. The system can be adapted to provide a number of variously sized and shaped vertical concrete columns with minimal adjustments to the system being necessary to effectuate formation of differently sized columns.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A system for vertically molding concrete columns during a column casting process, comprising:

a pair of elongate, U-shaped forms, positionable to define an elongate tetragonal mold cavity, each U-shaped form having a pair of elongate corners formed between an elongate end wall and a pair of elongate side walls;

a pliable liner, attached to each of the U-shaped forms, and having at least one patterned surface exposed toward the mold cavity and being operable to form a pattern in concrete in an uncured state;

a pair of notches, formed in each pliable liner externally of the mold cavity, extending along the pair of elongate corners and defining a pivotable joint between each of the side walls and the end wall; and securing structure, associated with the U-shaped forms and being configured to retain the forms in a secure configuration to receive the concrete in an uncured state within the mold cavity.

2. The system of claim 1, wherein the at least one side wall is movable between an open position and a closed position.

3. The system of claim 2, wherein the pivotable joint is biased and normally retains the side wall in the closed position.

4. The system of claim 2, wherein the U-shaped form is removable from a cured vertical concrete column by pivoting the side walls to the open position.

5. The system of claim 1, further comprising a pair of side retainers configured to project into the mold cavity between the pair of elongated U-shaped forms.

6. The system of claim 1, further comprising a removable center post positionable within the mold cavity and being configured to form an aperture in a cured concrete column.

7. The system of claim 1, wherein the securing structure includes a retaining wall adjacent to and parallel with each elongate end wall, and at least one tensioning member operatively coupled to the retaining wall to apply a retaining force to the U-shaped forms to retain the U-shaped forms in a tetragonal configuration when the concrete in the uncured state is received in the mold cavity.

8. The system of claim 7, further comprising a plurality of U-shaped forms defining a plurality of tetragonal mold cavities within the securing structure, to enable simultaneous vertical casting of multiple concrete columns.

9. The system of claim 8, wherein the at least one tensioning member is disposed outside of the mold cavities of the vertical column forms so as to retain the U-shaped forms in a tetragonal configuration without displacing the uncured concrete disposed in the mold cavity.

10. The system of claim 1, wherein the pliable liner extends across at least one pivotal joint internally of the mold cavity to form a substantially right angled internal corner in the pivotal joint.

* * * * *